US008191325B2

(12) United States Patent
Ting

(10) Patent No.: US 8,191,325 B2
(45) Date of Patent: Jun. 5, 2012

(54) CURTAIN WALL SYSTEM AND METHOD OF INSTALLING THE SYSTEM

(76) Inventor: Raymond M. L. Ting, Pittsburgh, PA (US)

( * ) Notice: Subject to any disclaimer, the term of this patent is extended or adjusted under 35 U.S.C. 154(b) by 153 days.

(21) Appl. No.: 12/684,290

(22) Filed: Jan. 8, 2010

(65) Prior Publication Data

US 2011/0167743 A1 Jul. 14, 2011

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 2/00*** | (2006.01) |
| ***E04B 5/00*** | (2006.01) |
| ***E04B 9/00*** | (2006.01) |

(52) U.S. Cl. ..... 52/235; 52/506.01; 52/506.04

(58) Field of Classification Search ..... 52/235, 52/506.01, 506.04, 506.03, 506.05, 508, 52/509

See application file for complete search history.

(56) References Cited

U.S. PATENT DOCUMENTS

| | | | | |
|---|---|---|---|---|
| 4,685,263 | A * | 8/1987 | Ting | 52/235 |
| 4,873,805 | A * | 10/1989 | Ting | 52/235 |
| 5,452,552 | A * | 9/1995 | Ting | 52/235 |
| 5,687,524 | A * | 11/1997 | Ting | 52/461 |
| 6,591,562 | B2 * | 7/2003 | Ting | 52/235 |
| 6,598,361 | B2 * | 7/2003 | Ting | 52/235 |
| 7,134,247 | B2 * | 11/2006 | Ting | 52/235 |

* cited by examiner

*Primary Examiner* — Mark Wendell
(74) *Attorney, Agent, or Firm* — Rosenberg, Klein & Lee

(57) ABSTRACT

A curtain wall system is assembled by a plurality of panels supported by a curtain-wall supporting mullion. The panels comprise one or more functional types of panels: transition panels and adjacent panels that can be joined at the top or/and bottom side of the transition panels because each of the panels has a male frame member is used to engage with the adjacent panels each having a female frame member. In each transition panel, a frame is assembled by a jamb frame member connecting with the upper frame member and the lower frame member. As a result, the curtain wall system can be easily erected in a bottom-up procedure, a top-down procedure, or the combination of the two.

20 Claims, 5 Drawing Sheets

CURTAIN WALL SYSTEM AND METHOD OF INSTALLING THE SYSTEM

BACKGROUND OF THE INVENTION

1. Field of the Invention

The present invention relates to a curtain wall system, specifically an improved system and method of erecting the curtain wall system.

2. Description of the Related Art

The typical panel erection method of an enhanced curtain wall (CW) system as generally described by Ting in U.S. Pat. No. 7,134,247 starts erecting the panels near the bottom of a building (i.e., a bottom-up process) and includes the following steps:

(1) placing a panel into an engaged position with two, generally vertical supporting mullions and sliding the panel downwardly into engagement with a previously erected panel below;

(2) fastening the upper frame segment of the panel with two panel fasteners to the adjacent mullions; and (3) engaging a panel water seal and a rain screen member to the upper frame segment.

It should be noted that one of the advantages of the above-mentioned enhanced curtain wall system is the absence of horizontal mullions. The lack of horizontal mullions simplifies the erection method and minimizes costs.

In new or renovation curtain wall (CW) construction in a downtown area, e.g., due to the limited available space for construction traffic, it is desirable to enclose the first floor last, necessitating top-down panel erection methods for the panels above the first floor. Also, a top-down renovation method allows immediate re-occupancy of a renovated floor, prevents water and/or construction debris from falling into a renovated lower floor, and avoids construction traffic going through a renovated lower floor to an upper floor undergoing renovation.

SUMMARY OF THE INVENTION

The curtain wall system of the present invention can be easily built in a bottom-up procedure, a top-down procedure or a combination of the two procedures. To achieve the above mentioned objectives, a preferred embodiment of the present invention provides a curtain wall system which comprises a plurality of panels and generally vertical mullions supporting the panels. Each of the panels are assemblies that comprise a facing panel and a separable frame. Panels may include one or more of the following types: top-down erecting panels, bottom-up erecting panels, and transition panels. A frame of each of the panels is formed by an upper member, a lower member, and at least one side or jamb member slidably engaging at least one adjacent mullion and connecting the above-mentioned upper and lower members. Each top-down erecting panel comprises a male structure protruding generally downward designed to be directly attached to an adjacent mullion. Each bottom-up panel comprises a male structure protruding generally upward designed to be attached to an adjacent mullion. Each transition panel comprises at least one upper and one lower male structures, the lower male structure protruding generally downward and the upper male structure protruding generally upward with one or both designed to be attached to an adjacent mullion. The upper members are capable of slidably engaging the lower members of upper-adjacent panels, and lower members that are capable of slidably engaging the upper members of lower-adjacent panels. As a preferred option, composite mullions may also be used comprising separate mullion head members and tubular mullion members connected by a fastening means to allow for larger shop and field tolerances on the dimensions and placement of mullions and panel members.

The present invention also discloses various lateral, top-down, bottom-up, and combined erection methods for installing a curtain wall system. A preferred method engages a first panel to an adjacent mullion at the upper portion of a building or other structure. Next, secure a lower male frame member to the adjacent mullion with at least one fastener. Lastly, place a second top-down panel generally below the first panel and secure the second panel to the adjacent mullion It is to be understood that both the foregoing general description and the following detailed description are exemplary, and are intended to provide explanation of the invention as claimed rather than limit the scope of the claims.

BRIEF DESCRIPTION OF THE DRAWINGS

FIG. 2(*b*) is a spread-out cross-sectional view showing an erection procedure embodiment of the present invention;

DETAILED DESCRIPTION OF THE INVENTION

In order to better explain the preferred embodiment and the best mode of using the invention, the following terminology will be used herein:

- a composite mullion: a curtain wall supporting structure comprising one or more mullion tube members and one or more mullion head members;
- a panel: one of a plurality of panels comprising a facing element of a building secured and nominally sealed to a separable panel frame typically located at a perimeter portion of the facing element with segments of the panel frame shop secured and sealed to the facing element;
- a male panel member: a member having a male leg or protrusion typically engaging a female panel member of an adjacent panel when erected;
- a female panel member: a member having a female groove or recess typically engaging a male panel member of an adjacent panel when erected;
- a water seal member: a member engaged with a panel member for providing a water sealing function of a panel joint when erected; and
- a rain screen member: a member attached to a panel member for providing the function of limiting water access to a water seal member when erected.

Figure 1:
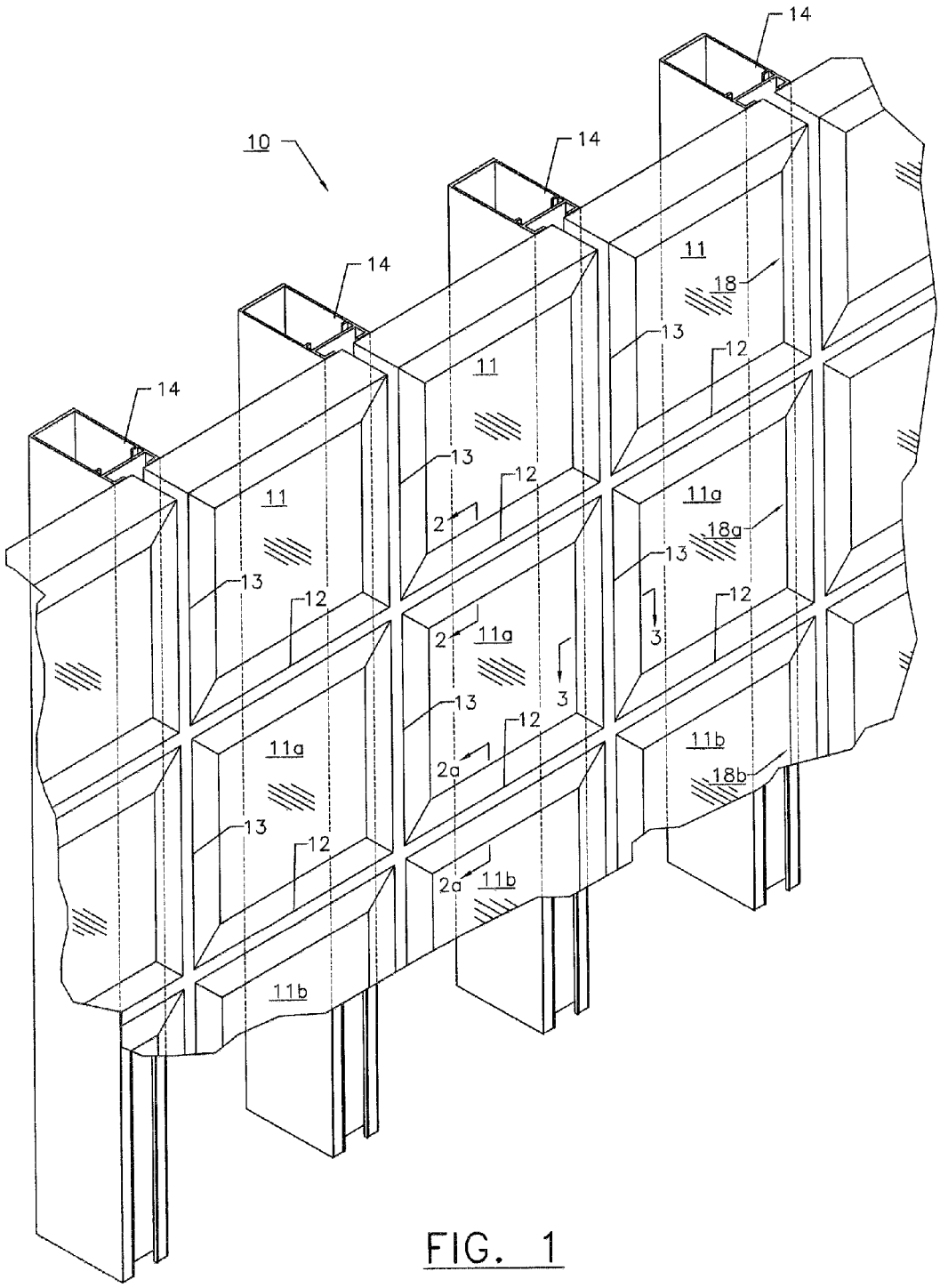
FIG. 1 is an isometric view of a curtain wall system according to an embodiment of the present invention.
Figure 2A:
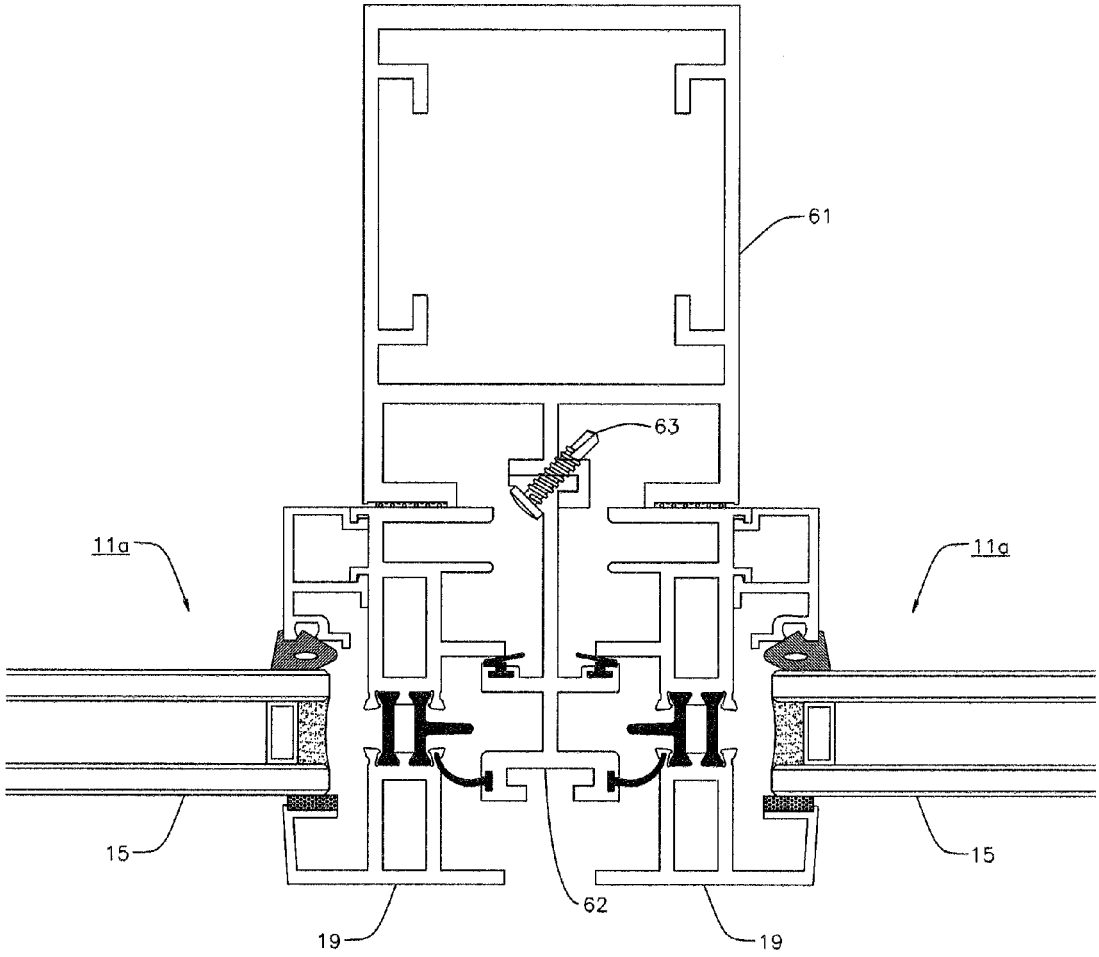
FIG. 2(*a*) is a partial cross-sectional view showing a wall joint of an embodiment of the present invention.
Figure 2B:
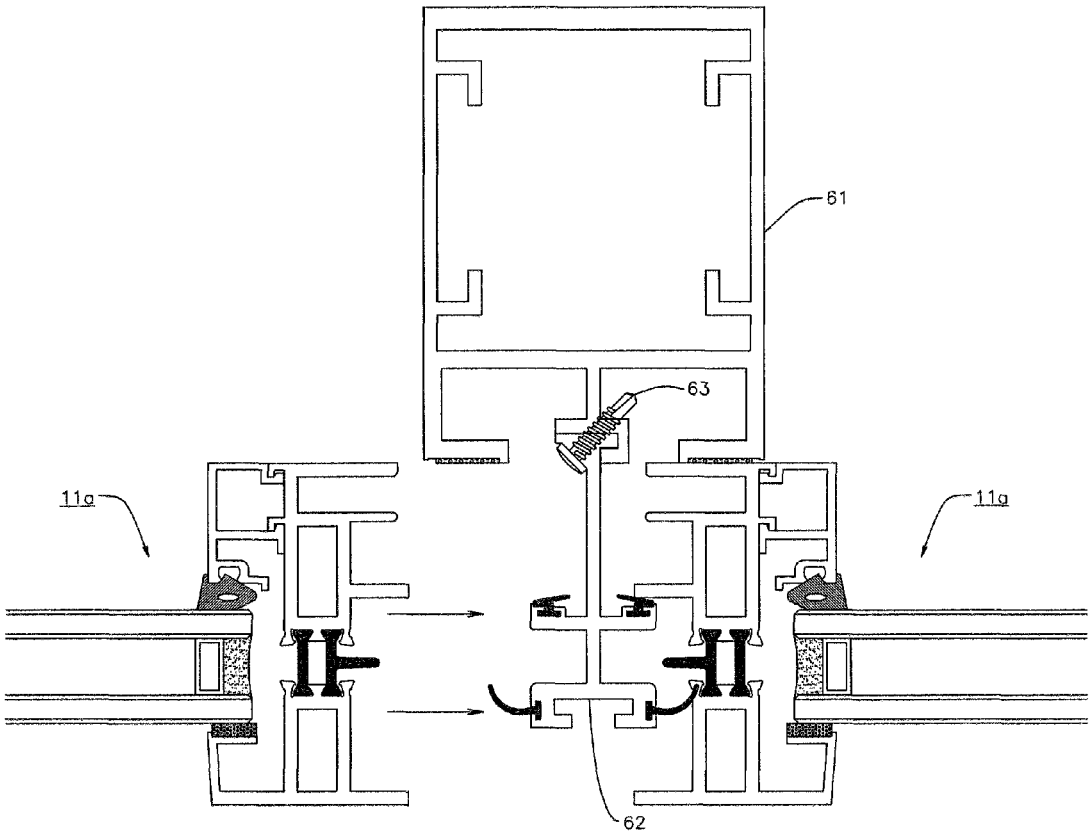

FIG. 1 illustrates a preferred embodiment of the present invention. The cross section view in FIG. 2(*a*) is taken along line 3-3 in FIG. 1. The curtain wall system 10 comprises an assembly of multiple curtain wall panels (e.g., panels 11, 11*a* and/or 11*b*) that are supported by one or more spaced-apart mullions 14 that are generally vertical and attached to a building floor or other supporting structure (not shown) in the absence of generally horizontal rails or mullions. The exterior horizontal wall joints 12 and exterior vertical wall joints 13 are formed between two adjacent wall panels (e.g., panels 11, 11*a* and/or 11*b*). The mullions preferably comprise a plurality of mullion tube members 61 and a plurality of mullion head members 62, as shown in FIG. 2(*a*). The mullion head member 62 is mounted to the mullion tube member 61 by at least one fastener, preferably spaced apart fasteners 63. In other words, the spaced apart fasteners 63 connect the mullion tube member 61 and the mullion head member 62 to form a preferred composite mullion 14, but a generally vertical series of single piece mullion sections or other mullion assemblies can also be used.

The panels 11, 11*a* and/or 11*b* are preferably panel assemblies comprised of dual glass or other facing elements 15 as shown on FIG. 2(*a*). The curtain wall system 10 can also comprise other facing elements such as aluminum plate, stone, composites, and foam facing panels. The preferred panels 11, 11*a*, and 11*b* shown in FIG. 1 also comprise exposed panel frames 18, 18*a*, and 18*b* separable from the facing elements 15. The exposed panel frames 18, 18*a*, and 18*b* are typically composed of extruded aluminum frame members and located at the perimeter of the facing elements 15 on all four edges, but the panel frames may also be composed of other solid materials and be in other locations, e.g., attached proximate to edges of a facing element, "hidden" from direct building exterior view if the facing elements are not transparent. Any one panel frame may also be any combination of hidden and exposed panel frames. Although the panels 11, 11*a* and 11*b* shown in FIG. 1 are substantially flat, other assembly sizes and shapes may also be used. However the individual panels are shaped, they are supported by one or more adjoining mullions and engaged with adjoining panels and mullions to form at least a portion of the curtain wall system 10. Several types of panels can be used as long as the panel joint designs are compatible.

Generally horizontal and generally vertical wall joints 12, 13 are typically formed between the adjoining panels. A joint 12 is located between upper and lower panels 11 and 11*a* or between upper and lower panel assemblies 11*a* and 11*b* or between other upper and lower panels with the joint 12 typically spanning between adjacent mullions 14. A joint 13 is located between two laterally- or side-adjacent panels 11, 11*a* and/or 11*b* that also partially enclose a mullion 14. However, many other types of curtain wall joints can be formed and used like non-linear joints, linear joints oriented at a diagonal or other direction, or joints made to accommodate wall protrusions or irregular panel boundary geometries.

Figure 3:
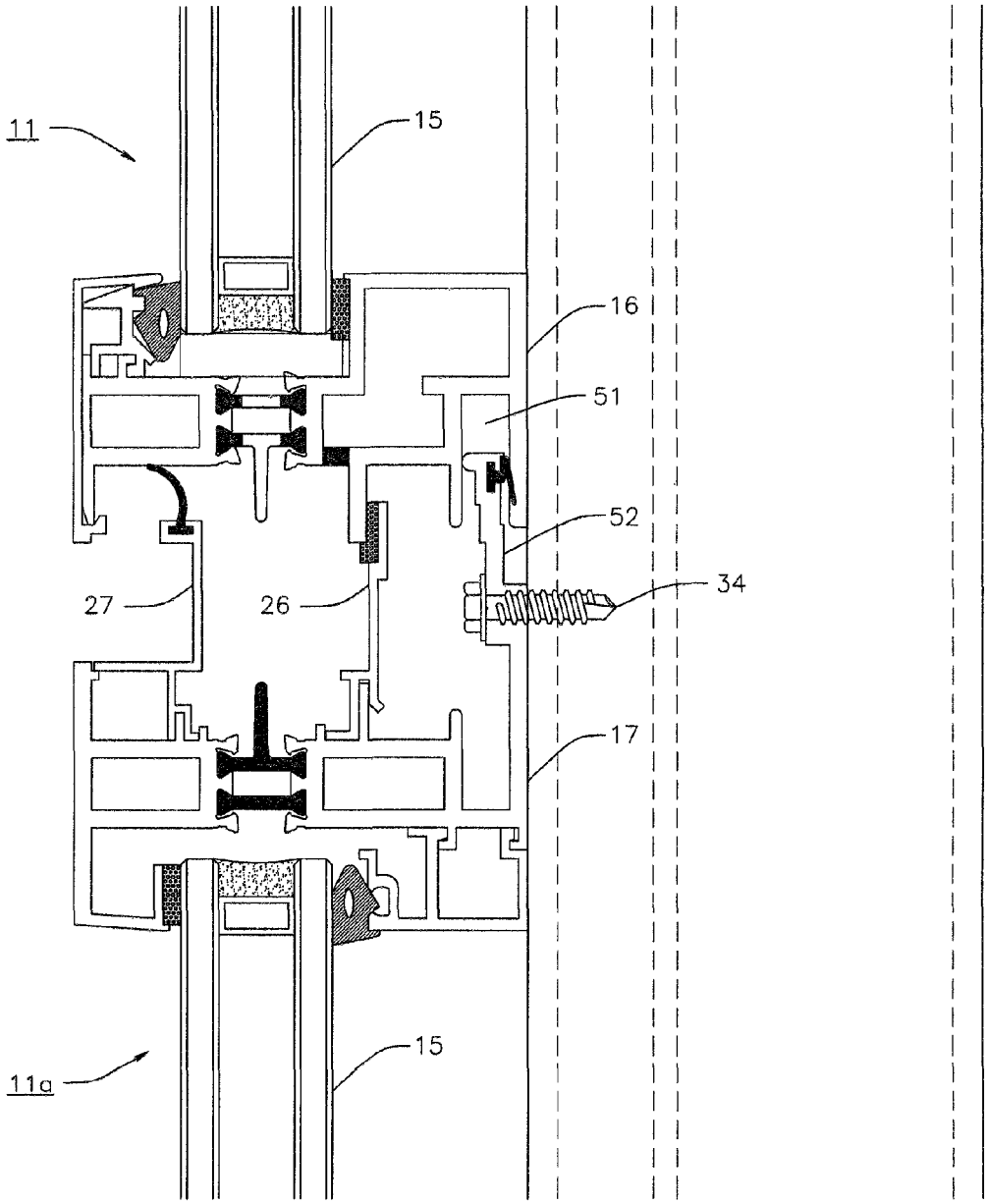
FIG. 3 is a partial cross-sectional view showing a wall joint of an embodiment of the present invention.
Figure 4:
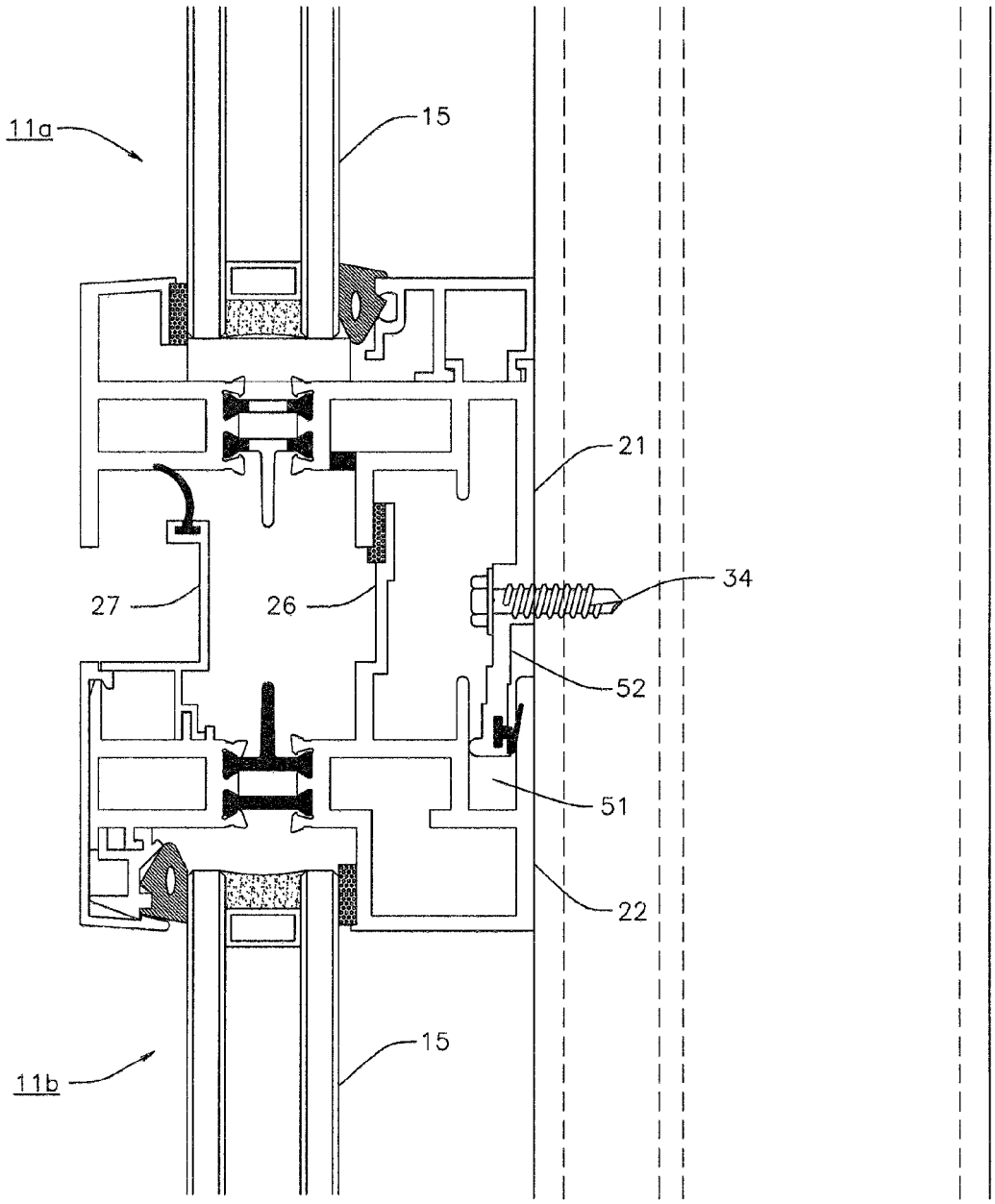
FIG. 4 is a partial cross-sectional view showing a wall joint of an embodiment of the present invention.

The preferred curtain wall system 10 comprises a plurality of transition panels 11*a*, a plurality of bottom-up erecting panels 11 some of which are joined at the top side of the transition panels 11*a* as shown in FIG. 3, and a plurality of top-down erecting panels 11*b*, some of which are engaging the bottom side of the transition panels 11*a* as shown in FIG. 4. Each of the preferred transition panels 11*a* has a upper male structure or frame member 17 as shown in FIG. 3, a lower male structure or frame member 21 as shown in FIG. 4 and at least one side or jamb frame member 19 as shown in FIG. 2(*a*) connecting the upper male structure 17 and the lower male structure 21 to form a transition frame 18*a*. In the embodiment of the present invention shown, the frame is rectangular. The adjacent bottom-up erecting panels 11 and adjacent top-down erecting panels 11*b* have a female structure 16 as shown in FIG. 3 or 22 as shown in FIG. 4 engaging the upper male structure 17 or the lower male structure 21 of the transition panel assembly 11*a*, such that upper-adjacent, bottom-up erecting panels 11 and lower-adjacent, top-down erecting panels 11*b* can be joined at the top or/and bottom sides of the transition panels 11*a* or to similar bottom-up or top-down erecting panels 11 and 11*b*.

FIG. 3 shows a typical fragmentary cross-section of one embodiment of a wall joint 12. The cross section view in FIG. 3 is taken along line 2-2 in FIG. 1. The bottom-up erecting panel 11 comprises an exterior-access glass facing member suitable for application in the spandrel or vision area of the building, e.g., allowing interior access so that the glass facing member 15 can be removed from a separable aluminum panel frame. The transition panel 11*a* comprises an interior-access glass facing material suitable for application in the vision area of the curtain wall system 10. The upper-adjacent panel 11 has an upper-male structure (not shown) at the top side and a lower female structure 16 at the bottom side. The wall joint 12 shown in FIG. 3 is formed between the lower female structure 16 with a female joint groove 51 of the upper-adjacent panel 11 and the upper male structure 17 with a male joint leg 52 of the transition panel 11*a*, wherein the upper male structure 17 is a male head frame member. The male structure 17 of the transition panel 11*a* is secured to the adjacent mullion 14 with two panel fasteners 34 or other securing means. A water seal member 26 and a rain screen member 27 are installed onto the male structure 17 of the transition panel 11*a*.

FIG. 4 illustrates a typical fragmentary cross-section of another embodiment of a wall joint 12 located between panels 11*a* and 11*b*. The cross section view in FIG. 4 is taken along line 2*a*-2*a* in FIG. 1. The transition panel 11*a* is an interior-access glass unit suitable for application in the vision areas of the curtain wall. The lower-adjacent panel 11*b* is an exterior-access glass unit suitable for application in the spandrel or vision areas of the curtain wall, e.g., if interior access to the facing panel 15 is restricted. The lower-adjacent panel 11*b* has a lower male structure (not shown) and an upper female structure 22 that is a female head frame member. The transition panel 11*a* has an upper male structure 17 (shown in FIG. 3) and a lower male structure 21 that is a male sill frame member. The wall joint 12 shown is formed between the lower male structure member 21 with a protrusion or male joint leg 52 of the transition panel assembly 11*a* and the upper female structure 22 with a female joint groove 51 of the lower-adjacent panel 11*b*. Also, the lower male structure 21 of the transition panel 11*a* can be directly secured to the mullion 14 with a panel fastener 34 or other panel-to-mullion securing means for supporting dead loads. Other direct, panel-to-mullion securing means may include welding, clamping, or crimping of a portion of a lower male structure 21 and an adjoining mullion 14. Panel-to-generally vertical mullion securing means avoids the need for a horizontal mullion or other intermediate support element transferring the panel dead load to one or more generally vertical mullions. As shown, the water seal member 26 is an integral part of the upper female structure 22. A rain screen member 27 is installed in the upper female structure 22 of the adjacent panel 11*b*.

According to the structure of one embodiment of the present invention, the transition panel 11*a* has the upper male structure 17 and the lower male structure 21, and the upper or lower-adjacent panel 11 or 11*b* has a female frame member 22 joined to the upper male structure 17 and the lower male structure 21. The other panels 11 and/or 11*b* can be easily installed in a bottom-up erection procedure or in a top-down erection procedure, e.g., from the transition panel assembly 11*a* down or from a roof transition member (not shown) down using top-down erecting panels 11*b*.

In another embodiment (not shown), a first alternative transition panel comprises upper and lower female frame members (similar to items 16, 22) and the adjacent panels 11 and/or 11*b* (in inverted positions from that shown in FIG. 1) with a lower female frame member of the first alternative transition panel engaging the upper male structure 17 of lower adjacent panel 11 and an upper female frame member of the alternative transition member engaging the lower male structure 21 of upper adjacent panel 11*b*. The other panels 11 and/or 11*b* can be easily installed in a bottom-up erection procedure or in a top-down erection procedure from the first alternative transition panel.

In still other embodiments (not shown), a second alternative transition element can be substituted for a transition panel, comprising upper and lower structures similar to transition panel 11*a* or the first alternative transition panel, but in the absence of a facing panel and/or in the absence of side or jamb members. In addition, the second alternative transition may also be incorporated into a floor or roof anchor attached directly to the building. A third alternative transition element can comprise an upper or lower structure similar to transition panel 11*a* or the first alternative transition panel, but not both, e.g., transitioning from a roof or other building element to top-down erecting panels.

The present invention also discloses methods for installing the curtain wall system. The methods can be used to erect the curtain wall system from down to up, or from up to down. Referring to FIG. 3, one embodiment of an initial bottom-up erection procedure steps using a transition panel 11*a* repetitively requires four major steps:

(1) placing a transition panel 11*a* between two adjacent mullions 14 at a lower location of the curtain wall system 10;

(2) securing the upper male structure 17 that is a male head frame member of the transition panel 11*a* into the curtain wall supporting mullion 14 with a panel fastener 34 or other direct means for securing;

(3) installing a rain screen member 26 and a water seal member 27 onto the upper male structure 17 of the transition panel 11*a*; and (4) placing a upper-adjacent panel 11 to engage with the transition panel 11*a* while also engaging the two adjacent mullions 14, wherein the upper adjacent panel 11 comprises a lower female structure 16 used to engage the upper male structure 17 of the transition panel 11*a*, such that the lower female structure of the upper-adjacent panel 11 engages the top side of the transition panel 11*a*.

Similarly, if a transition panel 11*a* is used at the upper region of the building, the lower portions of a curtain wall system 10 can be easily erected in the top-down procedure embodiment. Referring to FIG. 4, the procedure requires four major steps to install panels:

(1) placing a transition panel 11*a* adjacent to two mullions 14 at or near the top of the curtain wall system 10;

(2) securing the lower male structure 17 that is a male sill frame member of the transition panel assembly 11*a* into the curtain wall supporting mullions 14 with a panel fastener 34 or other direct means for securing;

(3) placing a lower adjacent panel 11*b* to engage with the transition panel 11*a* comprising an upper female structure 16 used to join the lower male structure 21 of the transition panel 11*a*, such that the lower-adjacent panel 11*b* engages the bottom side of the transition panel 11*a*; and (4) securing the lower male structure 17 of the lower adjacent panel 11*b* to the curtain wall supporting mullions 14.

In addition to the two above-mentioned procedure embodiments of the present invention, the curtain wall system 10 can also be erected in the absence of transition panels 11*a* or with alternative transition panels. For example, essentially a whole curtain wall system can be erected using lower panel assemblies 11*b* and third alternative transition elements with repetitive top-down erection procedures. The combination of the bottom-up and/or top-down erection procedures can be applied to other constructions allowing various portions to be erected from the bottom up or top down. It should also be noted that the top-down erection method can avoid the need to install separable rain screen members and/or water seal members after securing the lower male structure to the adjacent mullion.

FIG. 2(*b*) shows a typical cross-section of the installed wall joint 13 along line 3-3 in FIG. 1 showing an alternative embodiment of the mullion 14 as a composite mullion assembly formed by the mullion tube member 61 and the mullion head member 62 with spaced apart fasteners 63. The mullion head member 62 is designed to engage with panel assemblies on both adjacent sides.

The adjacent panel assemblies are transition panel assemblies 11*a*. FIG. 2(*b*) illustrates a preferred lateral erection procedure of the left side-to-right side sequence as described in the following steps:

1. sliding the mullion head member 62 into engagement with the mullion tube member 61 connected to the right-side transition panel assembly 11*a;*
2. applying at least one spaced apart fastener 63 to connect the mullion head member 62 and the mullion tube member 61 together to form a composite mullion 14;
3. sliding the left-side transition panel assembly 11*a* into an engaged position with the mullion head member 62; and
4. securing the transition panel 11*a* on the left hand side with the panel fastener 34 or other securing means as shown in FIGS. 3 and 4.

The above-mentioned lateral erection procedure is also essentially used to erect the other side-adjacent panels 11 and/or 11*b* to each other. Even though FIG. 2(*b*) illustrates a left-to-right erection procedure, the procedure can be easily modified for a right-to-left panel erection procedure.

In addition, there is no problem for panel leave-out and later back fill since the panels can be erected without side-adjacent panels as generally described in U.S. Pat. No. 7,134,247. This allows left out or back fill panel assemblies to be later erected, e.g., damaged panels can be removed and left out while continuing to erect side-adjacent panels.

The curtain wall system of the present invention is very convenient to use in building construction or renovation projects because the different kinds of lateral and vertical erection procedures, such as the bottom-up procedure, the top-down procedure, left-to-right, right-to-left and combinations of the procedures, can be performed flexibly in the above mentioned situations. The lateral erection procedures are flexible to respond to many contingencies encountered during construction, e.g., late arrival of materials. Therefore, constructors using the curtain wall system of the present invention can save money and time.

The systems and procedures described above are only the preferred embodiments to clarify the technical contents and characteristic of the present invention in enabling the persons skilled in the art to understand, make and use the present invention. However, they are not intended to limit the scope of the present invention. Any modification and variation according to the spirit of the present invention can also be included within the scope of the claims of the present invention.

What is claimed is:

1. A curtain wall system, comprising:

a curtain-wall supporting mullion; and a plurality of panels, supported by said curtain-wall supporting mullion and comprising:

a plurality of transition panels having a transition frame structure, each comprising:

an upper male frame member;

a lower male frame member; and at least one jamb frame member, connecting said upper male frame member and said lower male frame member to form a frame of each of said transition panels; and a plurality of top- and/or bottom-adjacent panels each having a frame structures different from said transition frame structure, each of said adjacent panels comprising a female frame member engaging one of said upper male and lower male frame members of said transition panel.

2. The curtain wall system according to claim 1, wherein said curtain-wall supporting mullion comprises:

at least one mullion head member; and at least one mullion tube member connected with said mullion head member, wherein said mullion head member engages adjacent ones of said panels located on laterally opposed sides of said mullion head member.

3. The curtain wall system according to claim 2, wherein said mullion head member is connected to said mullion tube member by at least one means for securing.

4. The curtain wall system according to claim 2, wherein said lower male frame member is attached to said mullion head member by dead load securing means in the absence of a generally horizontal mullion.

5. The curtain wall system according to claim 4, further comprising a rain screen member and a water seal member installed in said male head frame member.

6. A method for installing a curtain wall system, comprising steps of:

placing at least one transition panel having a transition frame structure into a curtain-wall supporting mullion, wherein said panel comprises an upper frame member and a lower male frame member, located respectively at top and bottom sides of said transition panel;

securing said lower male frame member into said curtain-wall supporting mullion with at least one means for directly securing said lower male frame member to said mullion, forming a secured transition panel; and placing at least one lower-adjacent panel having a frame structures different from said transition frame structure to engage with said secured transition panel along a generally vertical direction, wherein said lower-adjacent panel comprises an upper female frame member used to engage said lower male frame member of said secured panel.

7. The method for installing the curtain wall system according to claim 6 after the step of securing said lower male frame member into said curtain-wall supporting mullion, further comprising a step of:

installing a water seal member and/or a rain screen member on said upper female frame member.

8. The method for installing the curtain wall system according to claim 7, wherein said lower male frame member is a male sill frame member while said female frame member is a female head frame member.

9. The method for installing the curtain wall system according to claim 6, wherein said secured transition panel is fixed on said curtain-wall supporting mullion by securing said upper male frame member or said lower male frame member with at least one fastener, and wherein said curtain-wall supporting mullion comprises at least one mullion head member and at least one mullion tube member connected with said mullion head member by at least one fastener.

10. A method for installing two panel assemblies of a curtain wall system supported by a plurality of generally-vertical, spaced-apart mullions attached to one or more upper floors of a building, a first panel assembly comprising a first facing panel and a first panel frame comprising a first lower frame member, a first upper frame member, and one or more first side frame members connecting said first upper frame and first lower frame members, and a second panel assembly comprising a second facing panel and a second panel frame comprising a second upper frame member, a second lower frame member, and one or more second side frame members connecting said second upper frame and second lower frame members, wherein said first and second side frame members are slidably engaged with at least one of said mullions, wherein said second upper frame member is slidably engaged with said first lower frame member, and wherein said second panel frame is secured to at least one of said mullions after said first panel frame is secured to at least one of said mullions upon said first and second side frame members being slidably engaged with at least one said mullion, and wherein after said first lower frame member is slidably engaged with said second upper frame member, said method comprising:

positioning said first side member to slidably engage with at least one of said spaced-apart mullions;

securing said first panel frame to at least one of said spaced-apart mullions after said positioning step;

positioning said second panel frame member generally below said first panel frame to slidably engage with at least one of said spaced-apart mullions after said first directly securing step; and securing said second panel frame to at least one of said spaced-apart mullions after said positioning step for said second panel frame member;

wherein at least one of said first and second panel frames defines a transition frame structure, and the other of said first and second panel frames defines a frame structure different from said transition frame structure.

11. The method as claimed in claim 10 wherein said first lower frame member is a first male frame member and wherein said second upper frame member is a second female frame member, and wherein said second female frame member is disposed in sealed engagement with said first male frame member.

12. The method as claimed in claim 11 wherein said first panel assembly is directly supported by said mullion in the absence of a generally-horizontal mullion.

13. The method as claimed in claim 12 wherein said second panel frame is secured in position directly adjacent said first panel frame without and intervening rain screen and/or water seal members installed therebetween.

14. A curtain wall system comprising individual panel assemblies and supported on at least one generally-vertical, spaced-apart mullion attached to one or more upper floors of a building comprising:

a first facing panel and a first panel frame forming a first panel assembly, said first panel frame comprising a first lower frame member; a first upper frame member, and one or more first side frame members connecting said first upper and lower frame member portions;

a second facing panel and a second panel frame forming a first panel assembly, said second panel frame comprising a second upper frame member, a second lower frame member, and one or more second side frame members connecting said second upper and lower frame members; and wherein said first and second side frame members slidably engage at least one of said mullions, wherein said second upper frame member slidably engages said first lower frame member, and wherein said second panel frame is directly secured to said mullion after said first panel frame is directly secured to said mullion and after said first and second side frame members are slidably engaged with said mullion upon said first lower frame member being slidably engaged with said second upper frame member;

wherein at least one of said first and second panel frames defines a transition frame structure, and the other of said first and second panel frames defines a frame structure different from said transition frame structure.

15. A first curtain wall panel assembly comprising:

a first facing panel;

a first perimeter frame separably contacting said first facing panel and comprising first perimeter members including a first upper member, a first lower member, and at least one side member;

at least one curtain wall supporting mullion wherein said side member is disposed in sealed engagement with a first side-adjacent mullion;

an upper-adjacent second perimeter frame wherein said first upper member is disposed in sealed engagement with a lower member of said upper-adjacent perimeter frame;

a lower-adjacent, third perimeter frame wherein said first lower member is disposed in sealed engagement with an adjacent upper member of said lower-adjacent third perimeter frame;

wherein said first perimeter frame defines a transition frame structure, and said second and third perimeter frames each define a frame structure different from said transition frame structure;

wherein at least one of said perimeter members comprises a first male structure protruding generally vertically therefrom; and wherein said first male structure is secured to said first side-adjacent mullion prior to securing said third lower-adjacent perimeter frame.

16. The curtain wall system as claimed in claim 15 comprising a plurality of said curtain wall supporting mullions disposed in generally vertical manner without a generally horizontal mullion supporting said first panel assembly.

17. The curtain wall system as claimed in claim 15 wherein said facing panel comprises at least one glass plate.

18. The curtain wall system as claimed in claim 15 wherein said first side-adjacent mullion comprises a mullion head member and a mullion tube member threadably connected to said mullion head member.

19. The curtain wall system as claimed in claim 15 wherein said perimeter members of said first perimeter frame further comprises a second male structure protruding generally vertically in an opposite direction from said first male structure to be secured to said first side-adjacent mullion.

20. The curtain wall system as claimed in claim 19 wherein said upwardly-adjacent second perimeter frame comprises second perimeter members having a male structure protruding generally downward and directly secured to said first side-adjacent mullion in the absence of a generally horizontal mullion.

* * * * *